US008578521B2

(12) United States Patent
Rogers et al.

(10) Patent No.: US 8,578,521 B2
(45) Date of Patent: Nov. 12, 2013

(54) WORM DRIVE ADJUSTMENT FOR HEADGEAR SUSPENSION

(75) Inventors: David C. Rogers, Boston, MA (US); Duco W. Noordzij, Roxbury, MA (US); Peter L. Stokes, Cambridge, MA (US); Leonard M. Koenig, Boston, MA (US)

(73) Assignee: Artisent, LLC, Simpson, PA (US)

( * ) Notice: Subject to any disclaimer, the term of this patent is extended or adjusted under 35 U.S.C. 154(b) by 146 days.

(21) Appl. No.: 13/039,851

(22) Filed: Mar. 3, 2011

(65) Prior Publication Data

US 2011/0214223 A1 Sep. 8, 2011

Related U.S. Application Data

(60) Provisional application No. 61/339,435, filed on Mar. 4, 2010.

(51) Int. Cl.
*A42B 1/22* (2006.01)

(52) U.S. Cl.
USPC ..... 2/417

(58) Field of Classification Search
USPC ..... 2/410, 416, 417, 418, 419, 420, 424, 2/425, 906
See application file for complete search history.

(56) References Cited

U.S. PATENT DOCUMENTS

| | | | | |
|---|---|---|---|---|
| 2,568,559 | A | 9/1951 | Nolde | |
| 2,747,191 | A | 5/1956 | Hoffmaster | |
| 2,842,976 | A | 7/1958 | Young | |
| 3,595,094 | A | 7/1971 | Lemor | |
| 4,604,950 | A | 8/1986 | Sette | |
| 4,942,628 | A | 7/1990 | Freund | |
| 5,388,580 | A | 2/1995 | Sullivan et al. | |
| 6,216,394 | B1 | 4/2001 | Fenelon | |
| 6,457,210 | B1 | 10/2002 | Shirai et al. | |
| 6,584,867 | B2 | 7/2003 | Kennedy | |
| 6,647,556 | B2 | 11/2003 | Grepper et al. | |
| 7,117,551 | B1 | 10/2006 | Dinkler, II et al. | |
| 7,565,704 | B2 * | 7/2009 | Wu | 2/418 |
| 7,854,024 | B2 * | 12/2010 | Fang | 2/418 |
| 2004/0060154 | A1 | 4/2004 | Landry | |
| 2006/0206994 | A1 | 9/2006 | Rogers et al. | |

FOREIGN PATENT DOCUMENTS

JP 07293515 A 11/1995

OTHER PUBLICATIONS

International Search Report and Written Opinion mailed Aug. 30, 2011, for PCT Application PCT/US2011/027011, 10 pages.

* cited by examiner

*Primary Examiner* — Tejash Patel
(74) *Attorney, Agent, or Firm* — Morgan, Lewis & Bockius LLP

(57) ABSTRACT

A headgear adjustment mechanism is provided that includes a worm having a central axis of rotation, a first headband element, a second headband element, a spur gear, and a housing. The first headband element includes (i) a worm rack disposed in operative engagement with the worm, and (ii) a first pinion rack. The second headband element includes a second pinion rack. The spur gear is disposed in simultaneous operative engagement with the first pinion rack and the second pinion rack, and the housing at least partially encloses the first and second headband elements. During operation of the adjustment mechanism, rotation of the worm about the axis of rotation causes the first headband element and the second headband element to translate in opposite directions with respect to the worm, thereby adjusting a fit of the headgear.

24 Claims, 5 Drawing Sheets

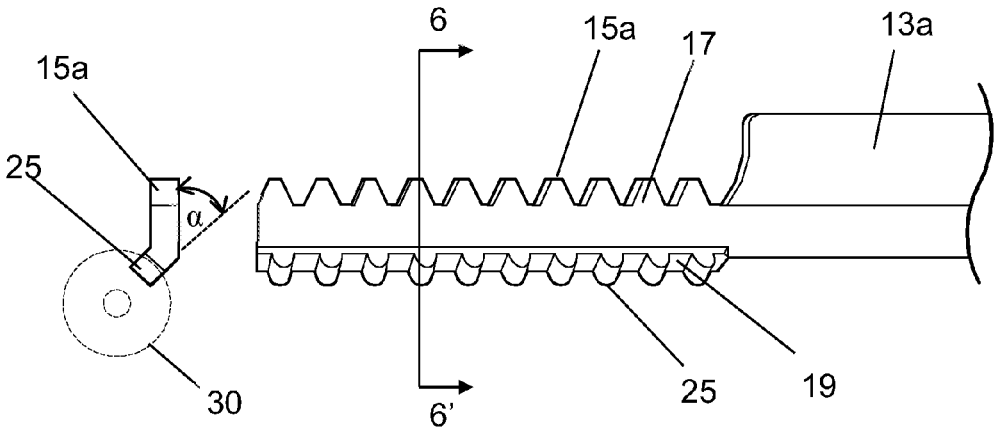
FIG. 6
FIG. 5a
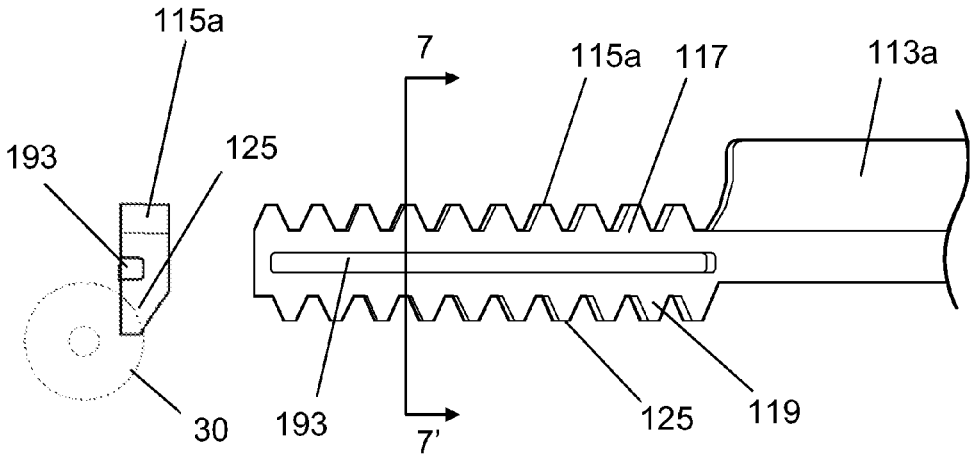
FIG. 7
FIG. 5b

WORM DRIVE ADJUSTMENT FOR HEADGEAR SUSPENSION

RELATED APPLICATION

This application claims priority to and the benefit of, and incorporates herein by reference in its entirety, U.S. Provisional Patent Application No. 61/339,435, which was filed on Mar. 4, 2010.

FIELD OF THE INVENTION

This invention relates to headgear suspensions and specifically to a gear mechanism used to adjust the fit of a headgear suspension system.

BACKGROUND OF THE INVENTION

Headgear suspensions are worn in a variety of environments and for various purposes. Headgear suspensions allow protective equipment, such as face shields and helmets, to be suspended from the head. A common element of headgear suspensions is the headband, usually fabricated from a thin band of plastic material formed into a generally circular shape with ends overlapping and joined at the back of the head.

Various means have been devised to adjust the girth of the headband to the extent necessary to fit the variety of head shapes and sizes of different wearers. One such means is illustrated in U.S. patent application Ser. No. 11/316,232 to Rogers, et al., which describes a headband having a flexible band that can be manually adjusted by the wearer. The two ends of the band are joined by a tab and slot arrangement. One or more tabs formed on one end of the band are inserted into one or more slots in a series of parallel slots formed in the other end of the band. The band is generally circular in shape with the selected slot(s) corresponding to a smaller or larger circumference for the headband.

A second method for adjusting the circumference of a headband is illustrated in U.S. Pat. No. 4,942,628 to Freund. According to Freund, the ends of a flexible band are connected, held in place, and adjusted by a ratchet mechanism. The ratchet adjustment knob has a set of cog teeth, which act on teeth formed in overlapping ends of the headband. Turning the knob one direction pulls the strap ends closer together, and turning the knob the other direction forces the ends apart.

The ratchet adjustment is generally preferred over the manual adjustment means because the headband can be adjusted while on the head of the wearer. The knob, however, must be large enough to be grasped and turned by the wearer's fingers, which may be covered with gloves.

The size and weight of the ratchet mechanism and the knob have disadvantages in some applications. For example, in order to access the knob in a protective helmet, the knob must be positioned below the edge of the helmet shell. Alternatively, the helmet shell must be significantly distanced from the wearer's head to provide room for the knob and to allow the wearer's fingers to operate the knob inside the helmet shell volume.

U.S. Pat. No. 2,747,191 to Hoffmaster describes a headgear adjustment mechanism that includes a worm attached to a headband end. During operation of the worm, the worm crawls along another headband component, thereby adjusting the headband circumference in a manner similar to the operation of a worm drive hose clamp. Hoffmaster's worm is exposed along the length of the headband and moves around the perimeter of the headband as it is adjusted.

Considering the above, there is a need for a headgear adjustment mechanism that can be operated by the wearer while on the wearer's head and that is smaller, easier to operate, and lighter-weight than conventional ratchet mechanisms.

SUMMARY OF THE INVENTION

The present invention provides a small, low-profile, continuous adjustment mechanism for a headgear suspension. The adjustment mechanism includes a worm drive, which provides a large gear reduction and considerable mechanical advantage, thereby making the adjustment mechanism easy to operate (e.g., it may be operated by one finger of a wearer). The large gear reduction also provides self braking to retain the headgear in its adjusted position. During operation of the worm drive, the adjustment mechanism advantageously remains in a fixed location along a perimeter of the headgear, thereby facilitating access by the wearer. In addition, due to its small size and low profile, the adjustment mechanism may be fit into small spaces in a wide variety of headgear devices, such as, for example, a helmet where the adjustment mechanism may be located just below a rim of the external shell. The adjustment mechanism also provides a continuous, non-ratcheted adjustment, which allows the fit of the headgear to be fine-tuned over a range of interest. The adjustment mechanism and headgear suspension may be made of resilient plastic materials.

In one aspect, the invention relates to a headgear adjustment mechanism that includes a worm having a central axis of rotation, and a first headband element including (i) a worm rack disposed in operative engagement with the worm, and (ii) a first pinion rack. The headgear adjustment mechanism also includes a second headband element including a second pinion rack, a spur gear disposed in simultaneous operative engagement with the first pinion rack and the second pinion rack, and a housing at least partially enclosing the first and second headband elements. The headgear adjustment mechanism is configured such that rotation of the worm about the axis of rotation causes the first headband element and the second headband element to translate in opposite directions with respect to the worm, thereby adjusting a fit of the headgear.

In certain embodiments, the worm is configured to be axially stationary with respect to the housing. The worm may include axial protrusions extending along the central axis of rotation, and the housing may include keepers configured to receive the axial protrusions and maintain the worm in a fixed axial position with respect to the housing. In certain embodiments, each of the first and second headband elements is configured to be disposed about at least a portion of a wearer's head. The first and second headband elements may be portions of a single band. In another embodiment, at least one of the first and second headband elements extends laterally around at least a portion of a circumference of a wearer's head.

In certain embodiments, the worm rack and the first pinion rack are disposed along opposite sides of the first headband element. In another embodiment, the worm rack includes teeth having a worm cut, and the first and second pinion racks include teeth having a spur gear cut. The headgear adjustment mechanism may include a forehead pad affixed to at least one of the first and second headband elements. The forehead pad may be configured to be disposed on a wearer's forehead. In certain embodiments, an external surface of the worm includes a knurled, ribbed, or roughened surface to facilitate engagement with a wearer's finger.

In certain embodiments, the first and second headband elements, the spur gear, and the worm, are made of plastic. The plastic may include resilient plastic, nylon, polypropylene, polystyrene, polyvinyl chloride, polyester, acrylonitrile butadiene styrene, and/or polyethylene. Rotation of the worm may allow non-ratcheted, continuous adjustment of the first and second headband elements.

In certain embodiments, the housing aligns the worm with the worm rack and the spur gear with the first and second pinion racks. The housing may include a stop to prevent movement of the first and second headband elements beyond a predetermined position. The stop may include an abutment disposed within a track. The abutment may be attached to the housing and the track may include a slot disposed longitudinally along at least one of the first and second headband elements. In certain embodiments, the abutment and track are configured to guide movement of at least one of the first and second headband elements during rotation of the worm. In another embodiment, rotation of the worm in a first rotational direction causes the first and second headband elements to move closer together, and rotation of the worm in a second rotational direction causes the first and second headband elements to move further apart.

In certain embodiments, the spur gear and the worm are disposed on opposite sides of the first headband element. The worm may be positioned for access by a wearer's finger. The housing may include a cover plate and an outer housing.

In another aspect, the invention relates to a headgear apparatus that includes a helmet shell adapted to be disposed upon the head of a person, and a headgear adjustment mechanism. The headgear adjustment mechanism includes a worm having a central axis of rotation, and a first headband element that includes (i) a worm rack disposed in operative engagement with the worm, and (ii) a first pinion rack. The headgear adjustment mechanism also includes a second headband element including a second pinion rack, a spur gear disposed in simultaneous operative engagement with the first pinion rack and the second pinion rack, and a housing at least partially enclosing the first and second headband elements. The headgear adjustment mechanism is configured such that rotation of the worm about the axis of rotation causes the first headband element and the second headband element to translate in opposite directions with respect to the worm, thereby adjusting a fit of the headgear. The description of elements of the embodiments above can be applied to this aspect of the invention as well. In certain embodiments, at least a portion of the worm is disposed below a lower edge of the helmet shell.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

While the invention is particularly shown and described herein with reference to specific examples and specific embodiments, it should be understood by those skilled in the art that various changes in form and detail may be made therein without departing from the spirit and scope of the invention.

FIG. 5*a* is a schematic, rear view of an end of a headband element, according to an illustrative embodiment of the invention.

FIG. 5*b* is a schematic, rear view of an end of a headband element, according to an illustrative embodiment of the invention.

FIG. 6 is a schematic, end view of the end of the headband of FIG. 5*a*, taken along cross section 6-6', according to an illustrative embodiment of the invention.

FIG. 7 is a schematic, end view of the end of the headband of FIG. 5*b*, taken along cross section 7-7', according to an illustrative embodiment of the invention.

DETAILED DESCRIPTION

It is contemplated that devices, systems, methods, and processes of the claimed invention encompass variations and adaptations developed using information from the embodiments described herein. Adaptation and/or modification of the devices, systems, methods, and processes described herein may be performed by those of ordinary skill in the relevant art.

Throughout the description, where devices and systems are described as having, including, or comprising specific components, or where processes and methods are described as having, including, or comprising specific steps, it is contemplated that, additionally, there are devices and systems of the present invention that consist essentially of, or consist of, the recited components, and that there are processes and methods according to the present invention that consist essentially of, or consist of, the recited processing steps.

It should be understood that the order of steps or order for performing certain actions is immaterial so long as the invention remains operable. Moreover, two or more steps or actions may be conducted simultaneously.

The mention herein of any publication, for example, in the Background section, is not an admission that the publication serves as prior art with respect to any of the claims presented herein. The Background section is presented for purposes of clarity and is not meant as a description of prior art with respect to any claim.

In certain embodiments, a "worm" is a cylindrical body having an axis of rotation that runs longitudinally through the center of the cylinder and a raised ridge running around the surface of the cylinder that forms a screw such that the raised ridge can mesh with teeth formed on another element as described herein.

In certain embodiments, a "spur gear" is a wheel-like gear having an axis of rotation at right angles to a plane of the wheel and teeth disposed in spaced relation along the outer rim of the wheel such that the teeth can mesh with teeth formed on another element as described herein. In certain embodiments, a "spur gear" is also called a "pinion" when the teeth of the spur gear mesh with a non-rotating toothed part, called a "rack," thereby converting rotation of the spur gear to translation of the rack.

In certain embodiments, "axial" refers to a direction relative to an element that is substantially parallel to the element's axis of rotation when the element is installed as shown and described herein. Similarly, in certain embodiments, "oblique" refers to a direction other than substantially parallel to the axial direction.

Referring now to FIGS. 1-7, embodiments of the present invention will be more thoroughly described.

Figure 1:
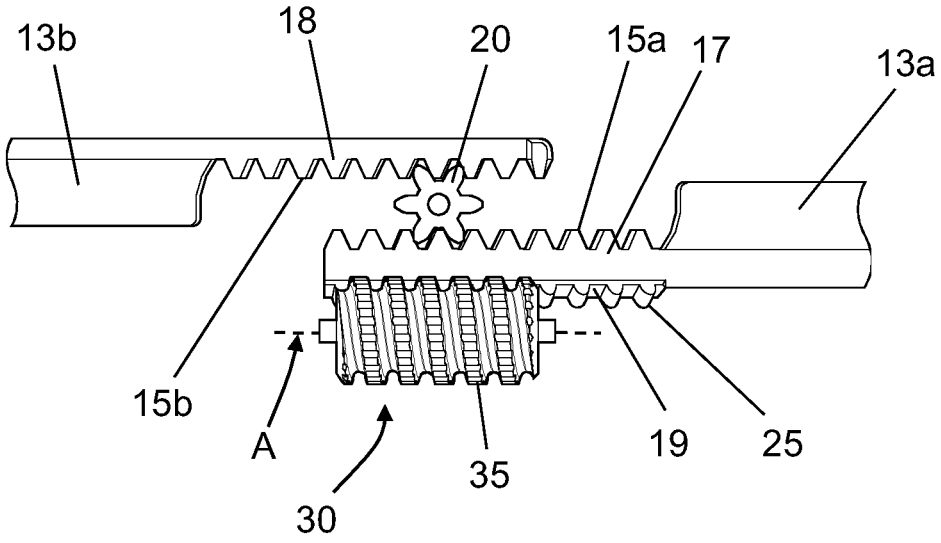
FIG. 1 is a schematic, rear view of components of an adjustment mechanism, according to an illustrative embodiment of the invention.

FIG. 1 depicts components of a headgear adjustment mechanism, in accordance with an embodiment of the present invention. The adjustment mechanism includes a first headband element 13*a*, a second headband element 13*b*, a spur gear 20, and a worm 30. An end of the first headband element 13*a* includes a first pinion rack 17 having a plurality of teeth 15*a*. An end of the second headband element 13*b* includes a second pinion rack 18 having a plurality of teeth 15*b*. The teeth 15*a*, 15*b* of the first and second pinion racks 17, 18 interface with the spur gear 20. The first headband element 13*a* also includes a worm rack 19 having a plurality of worm teeth 25 configured to interface with the worm 30. To provide improved grip with a wearer's finger, an outer surface of the worm 30 has roughened, ribbed, or knurled features 35.

Rotation of the worm 30 about a central axis A causes the first and second headband elements 13*a*, 13*b* to translate in opposite directions with respect to the worm 30. Specifically, rotation of the worm 30 causes the worm teeth 25 and the first headband element 13*a* to translate in a direction parallel to the central axis. As the first headband element 13*a* translates, the teeth 15*a* of the first pinion rack 17 cause the spur gear 20 to rotate. Rotation of the spur gear 20 causes the teeth 15*b* of the second pinion rack 18, and the second headband element 13*b*, to translate in a direction opposite the translation direction of the first headband element 13*a*. As a result, when the wearer rotates the worm 30, the first and second headband elements 13*a*, 13*b* are driven closer together or further apart, depending on the direction of rotation, thereby adjusting a fit of the headgear. The spur gear 20 thus serves as a pinion and operates on both the first and second pinion racks 17, 18, thereby adjusting the extent of overlap of the first and second headband elements 13*a*, 13*b*.

The adjustment mechanism may be used to adjust the relative positions of two flexible bands, which may be incorporated in a headgear suspension, either as a circumferential headband, a band across the top of the suspension from front to back, or ear to ear, or to contract or expand elements of a semi-spherical shape crowning the wearer's head. In certain embodiments, the adjustment mechanism is used to adjust a circumference of a headband used in a helmet suspension system, as described below.

Figure 2:
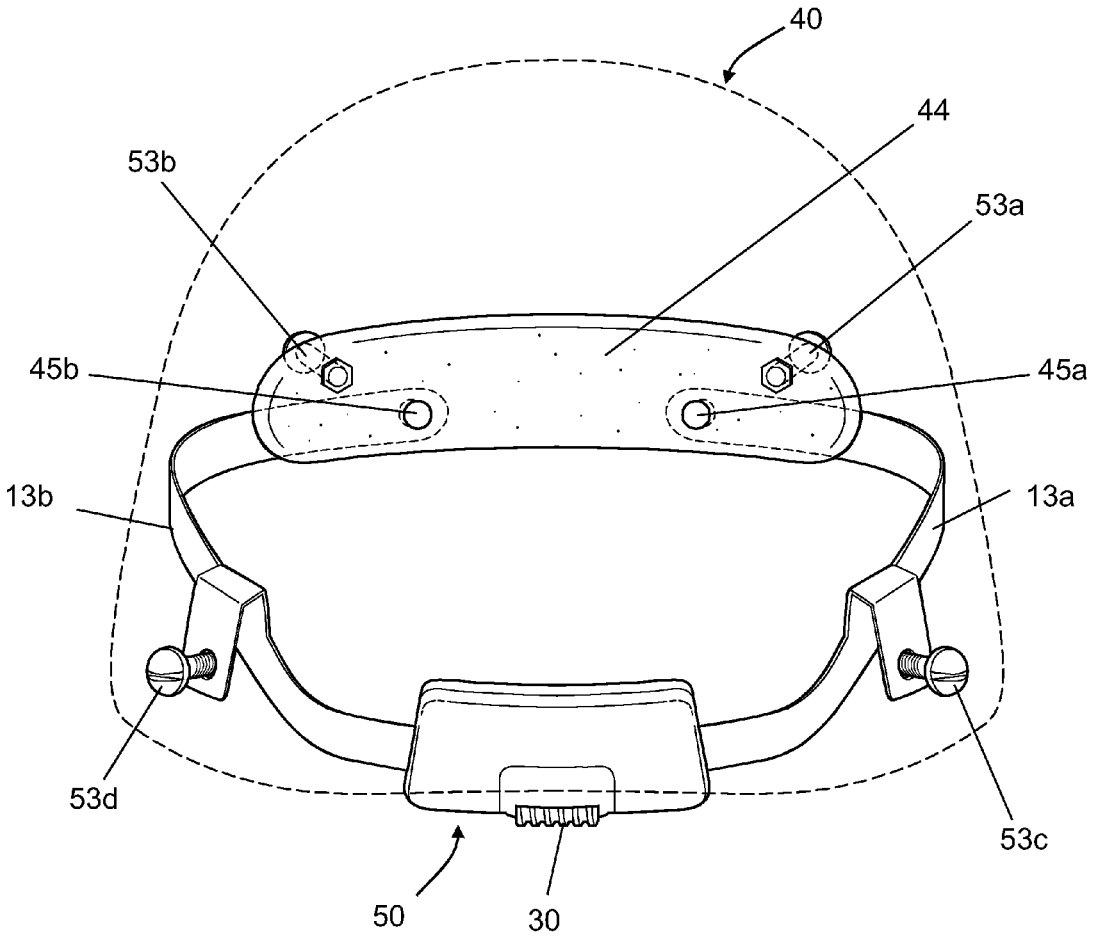
FIG. 2 is a schematic, rear view of an adjustment mechanism assembled within a protective helmet, according to an illustrative embodiment of the invention.

Referring to FIG. 2, an adjustment mechanism 50 is depicted as part of a helmet 40. The relative size and position of the helmet 40, as it might appear from the back of a wearer's head, are indicated by a dotted line. Inside the helmet 40, components of a helmet suspension system form a headband that adjusts to fit the size of the wearer's head.

In the depicted embodiment, the adjustment mechanism 50 is positioned near a lower edge of a helmet shell at the back of the helmet 40, such that the worm 30 is at least partially exposed below the edge for easy access by the wearer. The first and second headband elements 13*a*, 13*b* are secured to a forehead pad 44 at a front of the helmet 40 by fasteners 45*a*, 45*b*. The first and second headband elements 13*a*, 13*b* are joined at the back of the helmet 40 in the adjustment mechanism 50. The first and second headband elements 13*a*, 13*b* may be molded from a flexible plastic such as nylon, polypropylene, polystyrene, polyvinyl chloride, polyester, acrylonitrile butadiene styrene, and/or polyethylene. The flexible plastic material allows the first and second headband elements 13*a*, 13*b* to bend in a generally circular shape to conform to the wearer's head during rotation of the worm 30.

In the depicted embodiment, the forehead pad 44 is secured to the helmet shell by fasteners 53*a*, 53*b*, and the first and second headband elements 13*a*, 13*b* are secured to the helmet shell by fasteners 53*c*, 53*d*. In certain embodiments, the locations for fasteners 53*a*-53*d* are chosen to align with holes in the helmet shell, which may also be used to attach flexible chin straps (not shown) for securing the helmet 40 to the wearer's head. Other means and locations for fastening the headband elements to the helmet shell and securing the helmet 40 to the wearer's head are contemplated.

Figure 3:
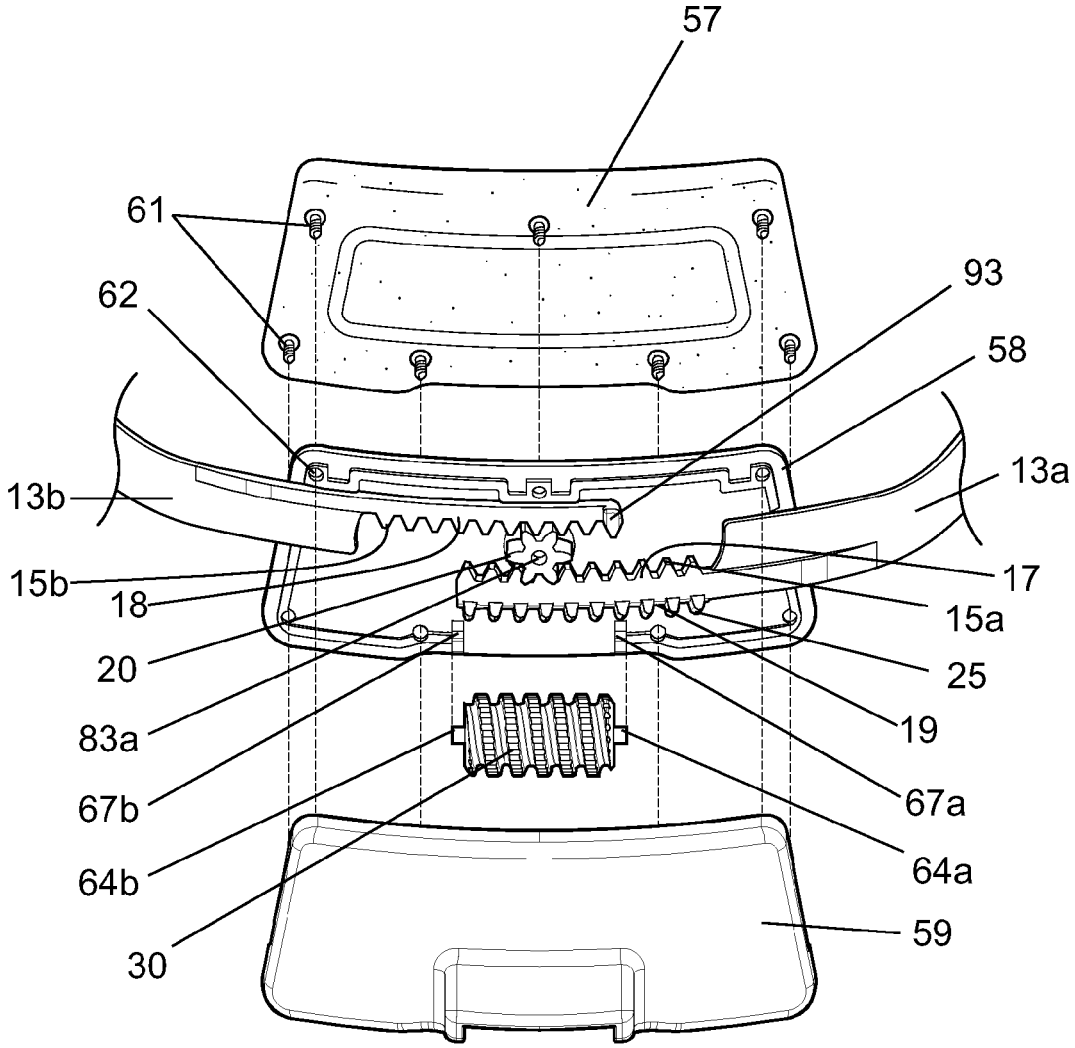
FIG. 3 is a schematic, exploded view of an adjustment mechanism and a portion of a headband, according to an illustrative embodiment of the invention.
Figure 4A:
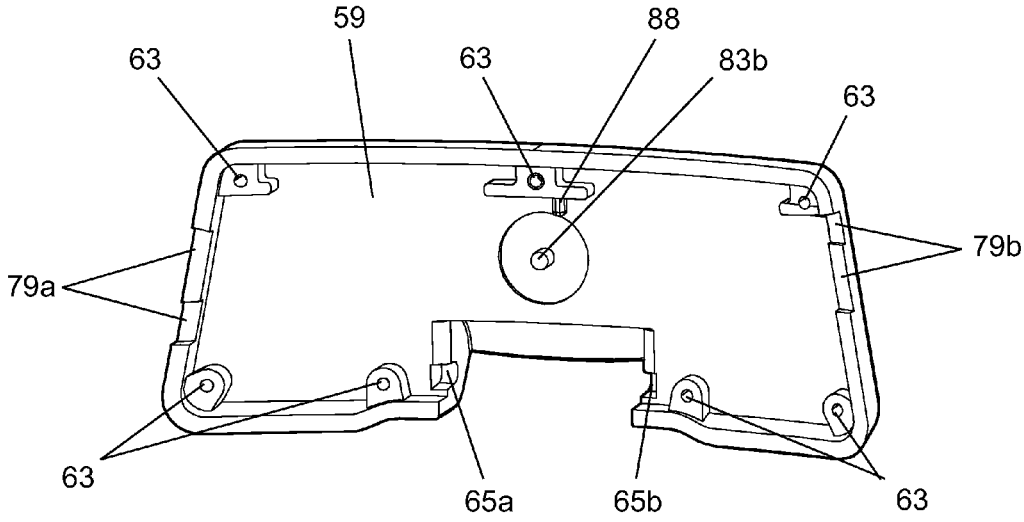
FIG. 4*a* is a schematic, interior view of an outer housing of an adjustment mechanism, according to an illustrative embodiment of the invention.
Figure 4B:
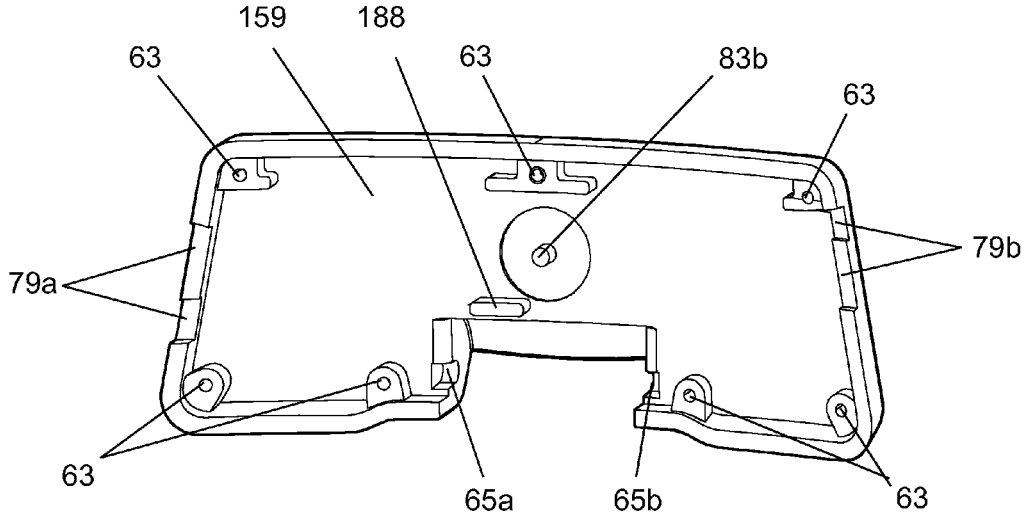
FIG. 4*b* is a schematic, interior view of an outer housing of an adjustment mechanism, according to an illustrative embodiment of the invention.

In the embodiments depicted in FIGS. 3, 4*a*, and 4*b*, the adjustment mechanism includes a comfort block 57, a cover plate 58, and an outer housing 59. The comfort block 57 provides impact absorption and/or a comfortable surface to contact the back of the wearer's head. The comfort block 57 may be fabricated from EVA, urethane, EPS foam, and/or other resilient materials. The cover plate 58 and the outer housing 59 provide mechanical features to locate, guide, and enclose additional components of the adjustment mechanism 50. The cover plate 58 is attached to the outer housing 59 by means of self tapping screws 61 passing through holes 62 in the cover plate 58 and secured into openings 63 in the outer housing 59. Other means known in the art may also be employed for fastening the cover plate 58 to the outer housing 59, including snap-fit, welded, and/or adhesive bonding. In certain embodiments, the comfort block 57 may be attached to the cover plate 58 by hook-and-loop materials to facilitate removal for cleaning or replacement, although other means for attachment known in the art may also be used.

As depicted, the worm 30 of the adjustment mechanism 50 includes axial protrusions 64*a*, 64*b*. The axial protrusions 64*a*, 64*b* are registered in concave features 65*a*, 65*b* in the outer housing 59 (seen in FIGS. 4*a* and 4*b*) and held in place by axial keepers 67*a*, 67*b*, formed as part of the cover plate 58 (seen in FIG. 3). The registration of the worm 30 by the concave features 65*a*, 65*b* and axial keepers 67*a*, 67*b* allows the worm 30 to rotate freely about axial protrusions 64*a*, 64*b*, yet remain generally fixed in location with respect to the outer housing 59.

The cover plate 58 and the outer housing 59 guide the first and second headband elements 13*a*, 13*b* into operative engagement with the worm 30 and the spur gear 20. Specifically, the first headband element 13*a* is slidably guided through an opening 79*a* and within a space formed between the cover plate 58 and the outer housing 59. Similarly, the flexible headband element 13*b* is slidably guided through an opening 79*b* and within a space formed between the cover plate 58 and the outer housing 59. The spur gear 20 rotates or pivots about a pivot protrusion 83*a* on the cover plate 58 and/or a pivot protrusion 83*b* on the outer housing 59. The spur gear 20 contacts the teeth 15*a*, 15*b* of the first and second pinion racks 17, 18 on the ends of the first and second headband elements 13*a*, 13*b*.

To prevent the first and second headband elements 13*a*, 13*b* from disengaging from the spur gear 20, at least one of the headband elements has a stop feature that interferes with a stop tab on the outer housing 59. For example, in the embodiment depicted in FIGS. 3 and 4*a*, the outer housing includes a stop tab 88, and the end of the first headband element 13*a* includes a stop tooth 93. When the first and second headband elements 13*a*, 13*b* are moved apart and the stop tooth 93 reaches the stop tab 88, interference between the stop tooth 93 and the stop tab 88 prevents further movement of the first and second headband elements 13*a*, 13*b*. By preventing further movement of the first and second headband elements 13*a*, 13*b*, the stop tab 88 acts as a limit stop, and disengagement with the spur gear 20 is avoided.

FIGS. 4*b*, 5*b*, and 7 depict an embodiment that provides an alternate mechanism to stop the relative movement of the adjustment mechanism at the maximum and minimum of its adjustment range. As depicted, the end of a first headband element 113*a* is formed with a track cavity 193 that extends longitudinally for a length substantially the same as a length of a first pinion rack 117 and a length of a worm rack 119. The first pinion rack 117 has teeth 115*a* that engage the spur gear 20. The worm rack 119 has teeth 125 that engage the worm 30. A longitudinal tab 188 in the outer housing 159 is positioned to project into the track cavity 193.

The track cavity 193 and the longitudinal tab 188 guide movement of the first headband element 113*a* and act as a limit stop. For example, when the first headband element 113*a* is caused to move longitudinally by rotation of the worm 30 (not shown), the first headband element 113*a* is guided by the longitudinal tab 188 sliding within the track cavity 193. Further movement of the first headband element 113*a* may cause the longitudinal tab 188 to interfere with an end of the track cavity 193. When the end of the track cavity 193 reaches the longitudinal tab, further movement of the first headband element 113*a* is prevented. The longitudinal tab 188 and the track cavity 193 also prevent an end of the first headband element 113*a* from traveling past the spur gear 20 to become disengaged. The sizes and positions of the longitudinal tab 188 and the track cavity 193 are chosen to provide a full range of movement of the first headband element 113*a*. In other embodiments, the positions of the longitudinal tab 188 and cavity 193 are reversed such that the cavity is disposed on the outer housing and the longitudinal tab is disposed on the first headband element 113*a*.

FIGS. 5*a* and 6 show the end of the first headband element 13*a* removed from the adjustment mechanism to better illustrate the unique function of an embodiment of the present invention. As depicted, the end of the first headband element 13*a* is formed with two types of gear teeth. The worm teeth 25 of the worm rack 19 on one side of the first headband element 13*a* are formed with a worm cut shape and are angled such that they are effective when interfaced with the worm 30. The teeth 15*a* of the first pinion rack 17 on a second side of the first headband element 13*a* are formed with a straight or spur gear cut shape such that they interface with the spur gear 20 shown in FIG. 1. Referring to FIG. 6, the worm teeth 25 may project away from the first headband element 13*a* at a worm rack angle $\alpha$. The worm rack angle $\alpha$ allows the worm 30 to be located further toward the back of the adjustment mechanism 50 for easier access by the wearer. The worm rack angle $\alpha$ may be, for example, between about 30 degrees and about 60 degrees, or about 45 degrees.

EQUIVALENTS

While the invention has been particularly shown and described with reference to specific preferred embodiments, it should be understood by those skilled in the art that various changes in form and detail may be made therein without departing from the spirit and scope of the invention as defined by the appended claims. It should be further understood that any of the features described with respect to one of the embodiments described herein may be similarly applied to any of the other embodiments described herein without departing from the scope of the present invention.

What is claimed is:

1. A headgear adjustment mechanism comprising:
a worm having a central axis of rotation;
a first headband element comprising:
a worm rack disposed in operative engagement with the worm; and
a first pinion rack;
a second headband element comprising a second pinion rack;
a spur gear disposed in simultaneous operative engagement with the first pinion rack and the second pinion rack; and
a housing at least partially enclosing the first and second headband elements,
wherein the first and second headband elements are adjusted in opposite directions with respect to the worm by rotation of the worm about the axis of rotation as the worm engages the worm rack and the spur gear engages the first and second pinion racks of the first and second headband elements respectively, thereby adjusting a fit of the headgear.

2. The headgear adjustment mechanism of claim 1, wherein the worm is configured to be axially stationary with respect to the housing.

3. The headgear adjustment mechanism of claim 2, wherein the worm comprises axial protrusions extending along the central axis of rotation, and the housing comprises keepers configured to receive the axial protrusions and maintain the worm in a fixed axial position with respect to the housing.

4. The headgear adjustment mechanism of claim 1, wherein each of the first and second headband elements is configured to be disposed about at least a portion of a wearer's head.

5. The headgear adjustment mechanism of claim 1, wherein the first and second headband elements are portions of a single band.

6. The headgear adjustment mechanism of claim 1, wherein at least one of the first and second headband elements extends laterally around at least a portion of a circumference of a wearer's head.

7. The headgear adjustment mechanism of claim 1, wherein the worm rack and the first pinion rack are disposed along opposite sides of the first headband element.

8. The headgear adjustment mechanism of claim 1, wherein the worm rack comprises teeth having a worm cut, and the first and second pinion racks comprise teeth having a spur gear cut.

9. The headgear adjustment mechanism of claim 1, comprising a forehead pad affixed to at least one of the first and second headband elements, wherein the forehead pad is configured to be disposed on a wearer's forehead.

10. The headgear adjustment mechanism of claim 1, wherein an external surface of the worm comprises a knurled, ribbed, or roughened surface to facilitate engagement with a wearer's finger.

11. The headgear adjustment mechanism of claim 1, wherein the first and second headband elements, the spur gear, and the worm, are made of plastic.

12. The headgear adjustment mechanism of claim 11, wherein the plastic comprises at least one member selected from the group consisting of resilient plastic, nylon, polypropylene, polystyrene, polyvinyl chloride, polyester, acrylonitrile butadiene styrene, and polyethylene.

13. The headgear adjustment mechanism of claim 1, wherein rotation of the worm allows non-ratcheted, continuous adjustment of the first and second headband elements.

14. The headgear adjustment mechanism of claim 1, wherein the housing aligns the worm with the worm rack and the spur gear with the first and second pinion racks.

15. The headgear adjustment mechanism of claim 1, wherein the housing comprises a stop to prevent movement of the first and second headband elements beyond a predetermined position.

16. The headgear adjustment mechanism of claim 15, wherein the stop comprises an abutment disposed within a track.

17. The headgear adjustment mechanism of claim 16, wherein the abutment is attached to the housing and the track comprises a slot disposed longitudinally along at least one of the first and second headband elements.

18. The headgear adjustment mechanism of claim 16, wherein the abutment and track are configured to guide movement of at least one of the first and second headband elements during rotation of the worm.

19. The headgear adjustment mechanism of claim 1, wherein rotation of the worm in a first rotational direction causes the first and second headband elements to move closer together, and rotation of the worm in a second rotational direction causes the first and second headband elements to move further apart.

20. The headgear adjustment mechanism of claim 1, wherein the spur gear and the worm are disposed on opposite sides of the first headband element.

21. The headgear adjustment mechanism of claim 1, wherein the worm is positioned for access by a wearer's finger.

22. The headgear adjustment mechanism of claim 1, wherein the housing comprises a cover plate and an outer housing.

23. A headgear apparatus comprising:

a helmet shell adapted to be disposed upon the head of a person; and a headgear adjustment mechanism comprising:

a worm having a central axis of rotation;

a first headband element comprising:

a worm rack disposed in operative engagement with the worm; and a first pinion rack;

a second headband element comprising a second pinion rack;

a spur gear disposed in simultaneous operative engagement with the first pinion rack and the second pinion rack; and a housing at least partially enclosing the first and second headband elements, wherein the first and second headband elements are adjusted in opposite directions with respect to the worm by rotation of the worm about the axis of rotation as the worm engages the worm rack and the spur gear engages the first and second pinion racks of the first and second headband elements respectively, thereby adjusting a fit of the headgear.

24. The headgear adjustment mechanism of claim 23, wherein at least a portion of the worm is disposed below a lower edge of the helmet shell.

* * * * *